US006009689A

United States Patent [19]

O'Connor

[11] Patent Number: 6,009,689

[45] Date of Patent: Jan. 4, 2000

[54] PACKAGING A STRIP OF MATERIAL IN LAYERS

[75] Inventor: Lawrence J. O'Connor, Winnipeg, Canada

[73] Assignee: Stac-Pac Technologies Inc., Christchurch, Bangladesh

[21] Appl. No.: 09/024,890

[22] Filed: Feb. 17, 1998

[51] Int. Cl.[7] ..... B65B 1/24

[52] U.S. Cl. ..... 53/429; 53/436; 206/494; 493/410; 493/413

[58] Field of Search ..... 53/429, 116, 117, 53/434, 435, 513, 520, 157, 446, 447, 544; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 2,659,187 | 11/1953 | Barnes | 53/446 |
| 3,245,680 | 4/1966 | Harrison et al. | 493/413 |
| 3,351,992 | 11/1967 | Carter | 53/429 |
| 3,645,759 | 2/1972 | Heiligman | 53/429 X |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,036,977 | 8/1991 | Schofield et al. | 206/389 |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| 22983/83 | 12/1983 | Australia . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian D. Battison

[57] ABSTRACT

A package of a continuous strip of material comprises a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected by a splice from the end of one stack to beginning of the next stack. The package is compressed to reduce the height of the stacks and maintained in the compressed condition by an evacuated sealed bag. The preferred package arrangement uses the package for pay off of the strip in an orientation in which the stacks are horizontal The spliced connection portions are flat against opposed sides of the package. Alternate stacks are reversed in orientation so that the strip of one stack is connected to the next through the splice portion in a manner which ensures that the same surfaces of the strips are connected through the package. The reversing is effected by twisting the strip before folding.

12 Claims, 13 Drawing Sheets

PACKAGING A STRIP OF MATERIAL IN LAYERS

This invention relates to a package of a continuous strip of material and to a method for forming a package of a continuous strip of material.

BACKGROUND OF THE INVENTION

This application is related to application Ser. No. 08/889,737 filed Jul. 8, 1997, now U.S. Pat. No. 5,927,051, application Ser. No. 08/878,826 filed Jun. 19, 1997, application Ser. No. 08/906,291 filed Aug. 5, 1997 and application Ser. Nos. 08/939,815, 08/939,444 and 08/939,881 all filed Sep. 24, 1997.

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any unwinding or support stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with larger traverse wound packages where tension control of large packages can be a problem due to the inertia of the package thus requiring a driven unwind stand. There is therefore no need when festooned packages are used for a complex unwind stand which takes up more space than may be available and involves significant cost.

Festooned packages are formed in a stiff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a layer. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be travelled by the strip from the slitting station to the festooning station with the potential for strip tension problems and damage to the strip.

There remains therefore a significant requirement for a package of this type but the techniques presently available are unsatisfactory for the above reasons leaving opportunity for an improved package structure.

SUMMARY OF THE INVENTION

It is one object of the present invention, therefore, to provide an improved package structure and a method of packaging a strip of material in which the package is formed in a plurality of layers each containing a strip and in which the layers are arranged in an orientation and arrangement such that the strip of each layer can be connected to that of a next adjacent layer with a connection which causes first sides of the strip to be connected to each other and second sides to be connected to each other.

According to one aspect of the invention there is provided a package of a strip of material comprising:

a strip of material having a first side edge, a second side edge, a first surface and a second surface;

a plurality of layers of the strip which are parallel and arranged side by side;

each layer comprising a plurality of folded portions of the strip, with each portion of the layer being folded relative to a next portion about a line transverse to the strip;

such that the first surface of each portion lies directly in contact with the first surface of one next adjacent portion and the second surface of each portion lies directly in contact with the second surface of a second opposed next adjacent portion;

and such that the first side edges of the portions are aligned and also the second side edges of the portions are aligned;

wherein the first surface of the strip is distinguishable from the second surface such that, for each layer, first fold lines at a first side of the layer have the first surface facing outwardly and the second surface facing inwardly and such that second fold lines at a second side of the layer opposite to the first side have the second surface facing outwardly and the first surface facing inwardly;

wherein the layers are arranged to define a first layer and a second layer with the first and second layers side by side;

wherein the first layer is arranged such that the first fold lines are all at one side of the package and the second fold lines are all at an opposed second side of the package;

and wherein the second layer is arranged such that the first fold lines are all at said opposed second side of the package and the second fold lines are all at said one side of the package.

Preferably the first layer is one layer of a first series of layers and the second layer is one layer of a second series of layers with the layers of the first and second series being arranged alternately across the package, wherein the layers of the first series are all arranged such that the first fold lines are all at one side of the package and the second fold lines are all at an opposed second side of the package and wherein the layers of the second series are all arranged such that the first fold lines are all at said opposed second side of the package and the second fold lines are all at said one side of the package.

Preferably the strip is continuous through each layer from a first end portion of the strip at one end of the layer to a second end portion of the strip at an opposed end of the layer, such that a full extent of the strip from the first end portion to the second end portion can be unfolded from the layer by pulling the strip from either end portion.

Preferably the layers are arranged side by side to define first and second end layers of the package and a plurality of intermediate layers and to define for each intermediate layer a first next adjacent layer on one side and a second next adjacent layer on an opposed side; the first end portion is connected to said one end portion such that the first surface of the strip of said first end portion is connected to the first surface of the strip of said one end portion and the second surface of the strip of said first end portion is connected to the second surface of the strip of said one end portion; one end portion of the strip of the first end layer forms a first end of the package for supply to an end use machine and one end portion of the strip of the second end layer forms a second end of the package for connection to a further package; the first end portion of the strip of each intermediate layer is connected by a spliced portion to one end portion of the strip of the first next adjacent layer and the second end portion of the strip of each intermediate layer is connected by a spliced portion to one end portion of the second next adjacent layer; such that the strip is continuous though the package and such that a full extent of the strip from the first end portion of said first end layer to said one end portion of said second end layer can be unfolded for supply to said end use machine Preferably the first end portion of the strip of each intermediate layer is connected by said spliced portion to the first end portion of the strip of the first next adjacent layer and the second end portion of the strip of each intermediate layer is connected by said spliced portion to the second end portion of the second next adjacent layer.

Preferably the first end portion of the strip of each intermediate layer is coplanar with and connected to the first end portion of the strip of the first next adjacent layer by a coplanar first traverse portion containing said spliced portion and extending diagonally across the layers and the second end portion of the strip of each intermediate layer is coplanar with and connected to the second end portion of the second next adjacent layer by a second coplanar traverse portion containing said spliced portion and extending diagonally across the layers.

Preferably the package is oriented for unwrapping such that the layers are horizontal and such that the first end of the package is provided by an uppermost one of the layers and the second end of the package is provided by a bottom one of the layers and such that the end portions of the layers lie in vertical planes.

According to a second aspect of the invention there is provided a method of forming a package of a strip of material comprising:

providing a web of a material in a supply;

forwarding the web from the supply;

slitting the web at a plurality of slitting knives at spaced positions across the width of the web to form a plurality of separate strips of the material, each strip having a first side edge, a second side edge, a first surface and a second surface;

simultaneously laying the strips to form a plurality of parallel side by side layers each containing a strip of the material;

each layer being formed by folding the strip to form a plurality of folded portions of the strip, wherein each portion of the layer is folded relative to the next portion of the layer about a line transverse to the strip;

such that the first surface of each portion lies directly in contact with the first surface of one next adjacent portion and the second surface of each portion lies directly in contact with the second surface of a second opposed next adjacent portion;

and such that the first side edges of the portions are aligned and also the second side edges of the portions are aligned;

and, prior to forming the layers, twisting at least one of the strips about its length through 180 degrees so as to invert the strip in its respective layer relative to the strip of at least one of the other layers.

Preferably the method includes laying the strips so as to be continuous though each layer from a first end portion of the strip at one end of the layer to a second end portion of the strip at an opposed end of the layer, such that a full extent of the strip from the first end portion to the second end portion can be unfolded from the layer by pulling the strip from either end portion; and connecting the first end portion of said at least one strip to one of the first and second end portions of the strip of a next adjacent layer by a spliced portion.

Preferably the first end portion of said at least one strip is connected by said spliced portion to the first end portion of the strip of the next adjacent layer.

Preferably the spliced portion is coplanar with and connected to the first end portion of said at least one strip and the first end portion of the strip of the next adjacent layer and extends diagonally across the layers.

Preferably the method includes twisting each alternate one of the strips about its length through 180 degrees so as to invert each alternate strip in its respective layer relative to the strip of the other layers:

Preferably the package is oriented for unwrapping such that the layers are horizontal and such that one end of the package is provided by an uppermost one of the layers and a second end of the package is provided by a bottom one of the layers and such that the end portions of the layers lie in vertical planes.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

As shown in FIGS. 1 to 4, the package comprises a generally rectangular body 10 formed from a strip or sheet 11 of a pliable material to be packaged and generally this material will be of a fibrous nature formed by woven or non-woven material although this is not essential to the package structure. Many materials of various thicknesses can be packaged using the festooning technique provided they can accept the creasing necessary at the end of each portion.

Figure 2:
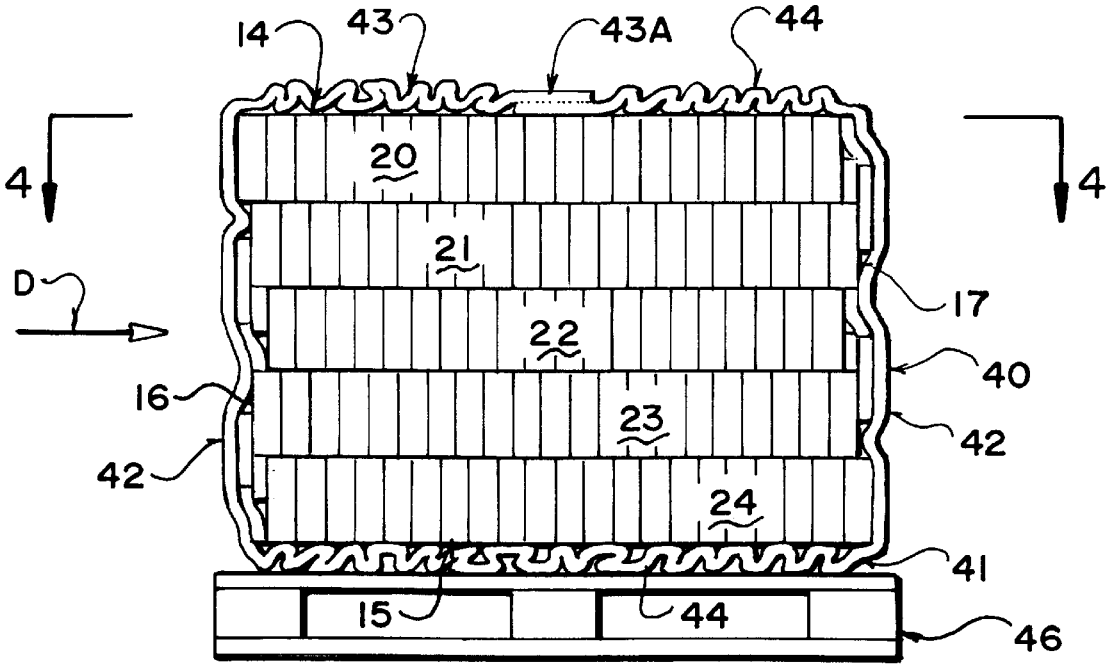
FIG. 2 is a cross sectional view along the lines 2—2 of FIG. 1, with the flexible packaging material and a pallet included and the package rotated to its normal transportation position with the layers horizontal.
Figure 3:
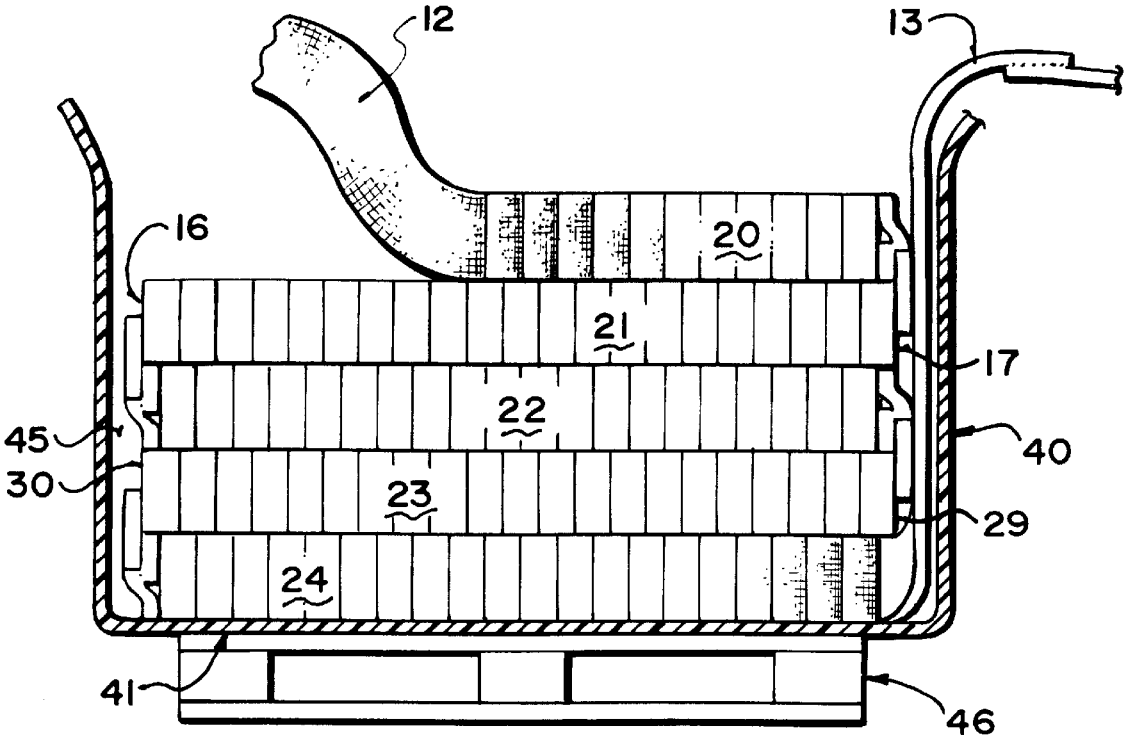
FIG. 3 is a cross sectional view similar to that of FIG. 2 showing the package opened and the strip partly withdrawn.
Figure 4:
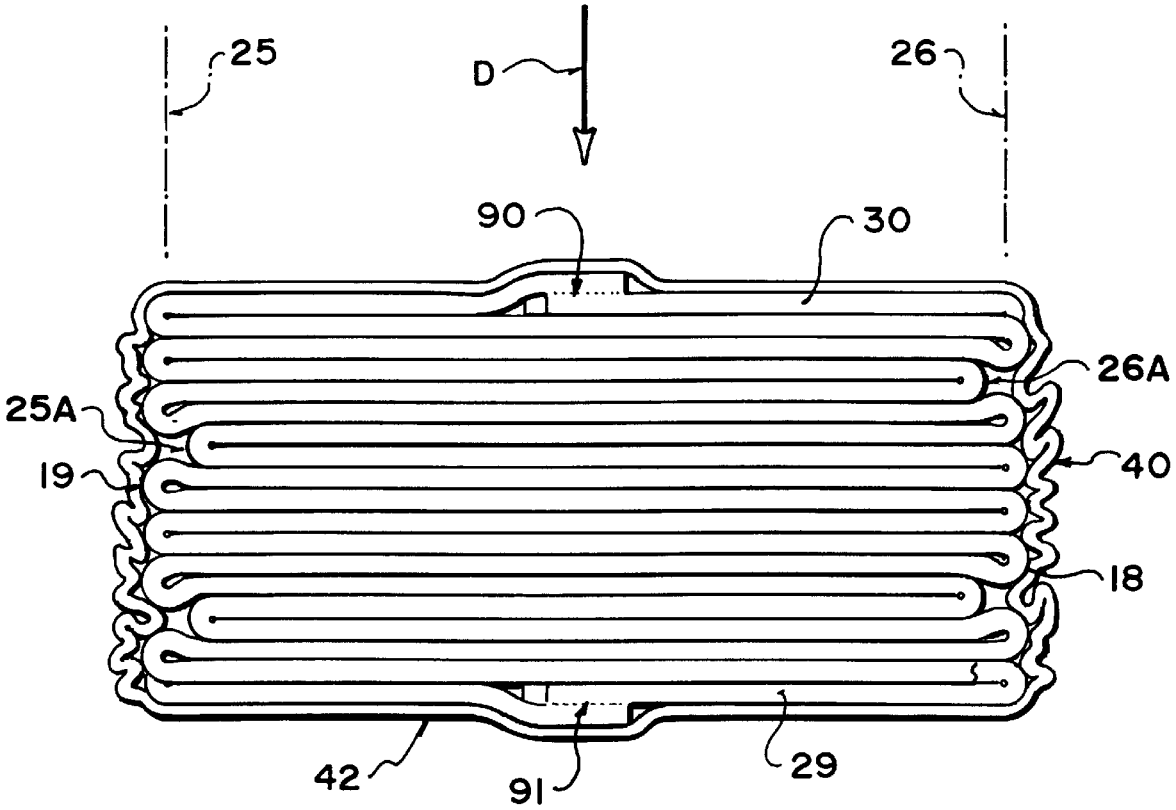
FIG. 4 is a cross sectional view along the lines 4—4 of FIG. 2.

The strip has a leading end 12 and a trailing end 13 of the package and otherwise is substantially continuous through the package. The package when oriented in its normal position for transportation or use as shown in FIGS. 2, 3 and 4 has a top 14, a bottom 15, two sides 16 and 17 and two ends 18 and 19.

The package is formed by a plurality of layers of strips. Each layer forms a stack. In the embodiments shown in FIGS. 1 to 4, there are five layers of the strip indicated respectively at 20, 21, 22, 23 and 24. The layers are parallel and an outer side of the layer 20 forms the top surface 14 of the package and an outer side of the layer 24 forms the bottom surface 15 of the package. The package thus has end layers 20 and 24 and a plurality (in this embodiment three) of intermediate layers.

It will be appreciated that the dimensions of the package can of course be varied in accordance with the requirement so that the number of layers, the length of each layer and the height of each layer can be varied and in FIGS. 5 to 10, the package is shown as having eight layers.

Figure 1:
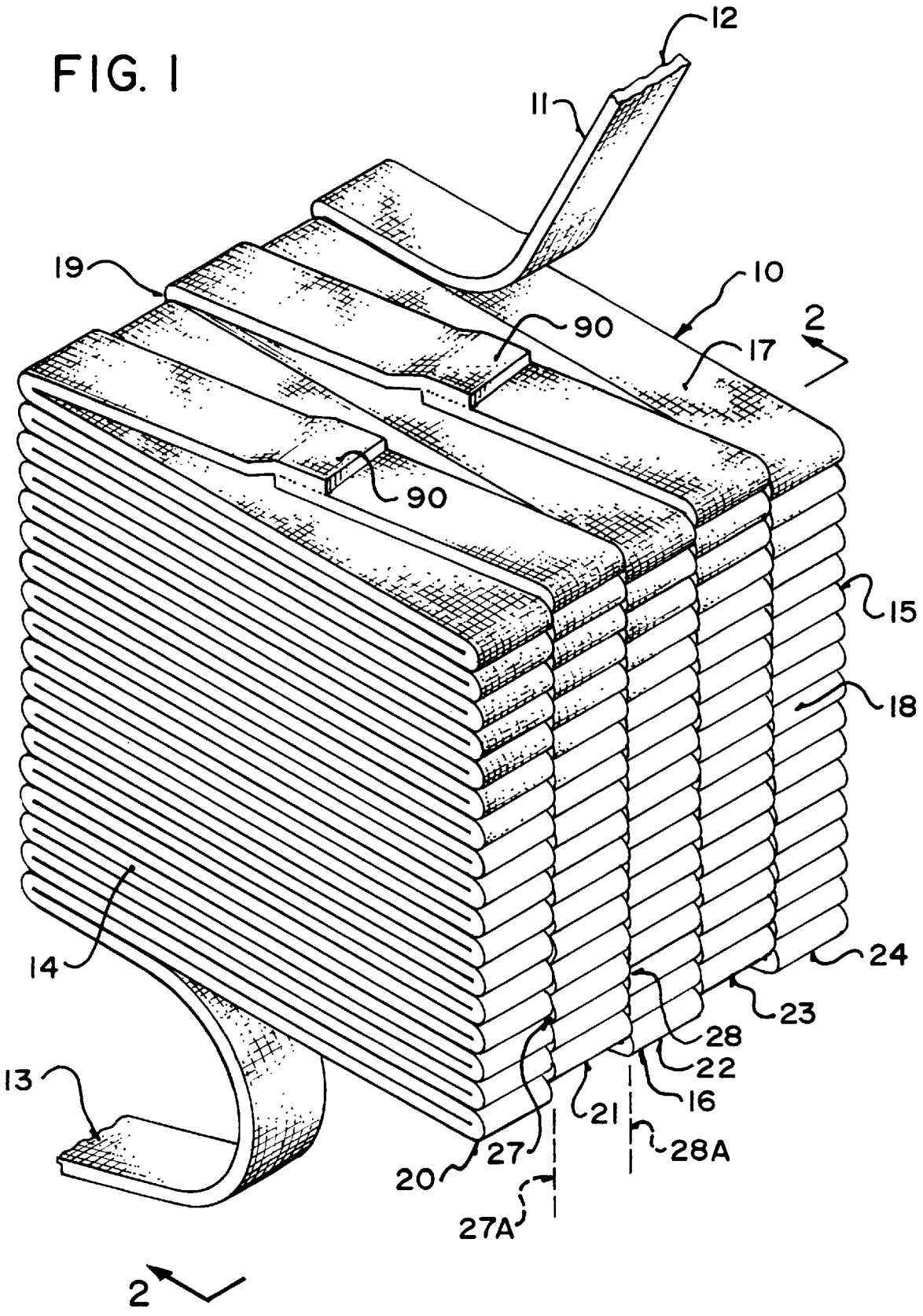
FIG. 1 is a schematic isometric view of a package of a continuous strip according to the present invention, the package including five layers of the strip and being shown with the flexible packaging material omitted for convenience of illustration.

Each layer of the strip comprises a plurality of portions of the strip which are laid on top of one another. Thus as shown in FIG. 4 the portions are folded back and forth to form accordion folded sheets at respective end fold lines 25 and 26 so that the fold lines lie in a common vertical plane defining the ends 18 and 19 of the package. Each portion of the strip lies directly on top of the previous portion so that, with the strip being of constant width as shown, the side edges 27 and 28 of the portions of the strip lie in common vertical planes 27A, 28A as shown in FIG. 1. In other words, the side edges 27 of the strips of the layers are aligned and define a first set of lines in the common plane 27A at right angles to the strip portions which contain all the side edges 27 of the layer and similarly, the side edges 28 of the strips of the layers are aligned and define a second set of lines in the common plane 28A at right angles to the strip portions which contain all the side edges 28 of the layer.

Thus the package is formed by laying the portions each on top of the next from a bottom portion 29 up to a top portion 30 to form the layer. The package is thus formed from the plurality of layers each of which has a length equal to that of the other layers and therefore equal to that of the package and the layers are formed up to a common height which is therefore equal to the height of the package.

The package is wrapped by a flexible packaging material preferably of heat sealable non-permeable plastics which encompasses the whole of the package as indicated at 40. The packaging material includes a base 41 and sides 42 with a top 43 wrapped over the top of the package and heat sealed as indicated at 43A. The sealed package allows air to be extracted from the package and this vacuum action can be used with physical compression from the sides 16 and 17 of the package so as to compress the package to a reduced height in a vacuum packaging system. The amount of compression can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D which is at right angles to the surfaces of the portions of the strip. This acts to compress the thickness of the portions so that the dimension of each layer in the direction D is reduced by that compression. Compression along the portions or at right angles to the layers is not possible since this will act to distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the layers in intimate contact.

In the rest condition of the packaging material as shown in FIG. 3, the base 41 of the packaging material 40 is shaped and dimensioned so as to be slightly larger than the rest or uncompressed condition of the package structure itself. In this way the package structure can be readily inserted into the formed plastics packaging material and can remain in place loosely held by the packaging material. During transportation and storage the package structure is in the compressed and vacuumed condition. In this condition the base 41 of the packaging material and the top 43 of the packaging material are both compressed in the direction D so as to form wrinkles or creases 44. When the vacuum is released, however, the expansion of the package from its compressed condition to its normal relaxed condition will cause the creases 44 to be extracted as shown in FIG. 3. Also, in the expanded condition of FIG. 3, there is a slight space 45 between the sides 42 of the packaging material and the sides 16 and 17 of the package structure allowing the strip to be pulled in the unwrapping process from the ends of the layers without compressing or distorting the end portions 29 and 30.

When wrapped, compressed, sealed and mounted on a transportation pallet 46, the package structure is oriented so that the layers are horizontal. In this orientation, the application of vertical loads onto the package from other packages causes the transfer through the package structure to the pallet 46 without distorting or damaging the strip. This occurs due to the fact that the strip is relatively stiff across its width and when compressed into the layers, the strips together form a substantially rigid structure.

This orientation of the package used for unwinding the package is shown in FIG. 3. Thus in FIG. 3 a partial unwinding of the structure is shown in that the top 43 is opened and the leading end 12 of the strip is found and pulled through the opening. By placing the package in this orientation, therefore, each layer in turn can be unwound without the danger of the layer toppling since it is lying on its side supported by the underlying layers.

Each layer is connected to the next by a traverse portion of the strip which extends from one layer to the next. Thus the intermediate layers are each connected so that one end of the strip of that layer is connected to the next adjacent layer on one side and the other end of the strip of that layer is connected to the next adjacent layer on the opposite side. A technique for connecting the strip of each layer to the next layer is shown and described in more detail hereinafter.

As shown in FIG. 4, some of the transverse fold lines can be offset from all or some of the others in a direction longitudinal of the portions. Thus the fold lines 25A are offset inwardly from the plane 25 at one end and the fold lines 26A are similarly offset from the plane 26. This technique can be used to prevent build-up at the ends of the package when the material being packaged is resistant to folding leaving a fold of increased height.

Figure 5:
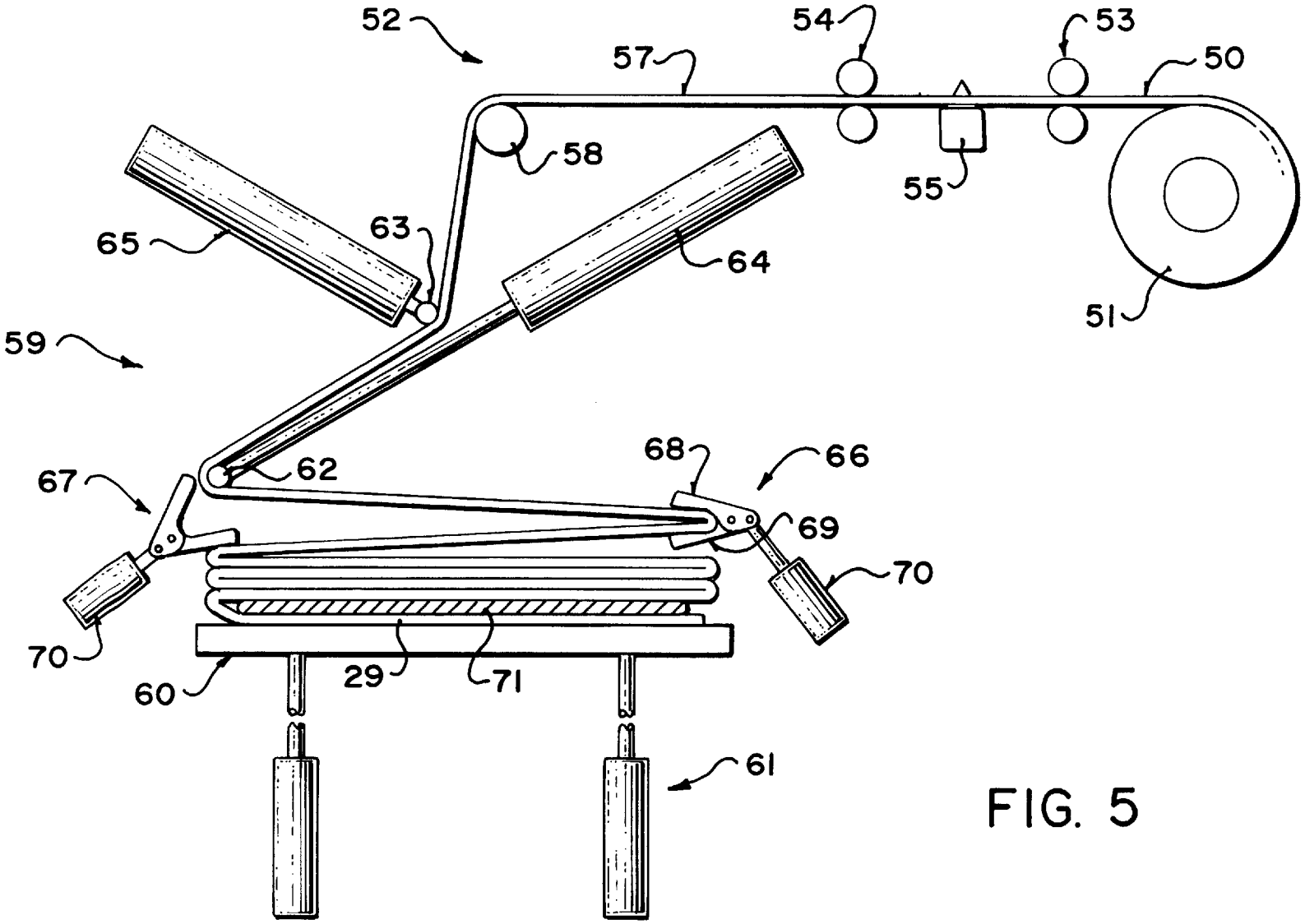
FIG. 5 is an end elevational view of an apparatus and method for forming the package of FIG. 1.
Figure 6:
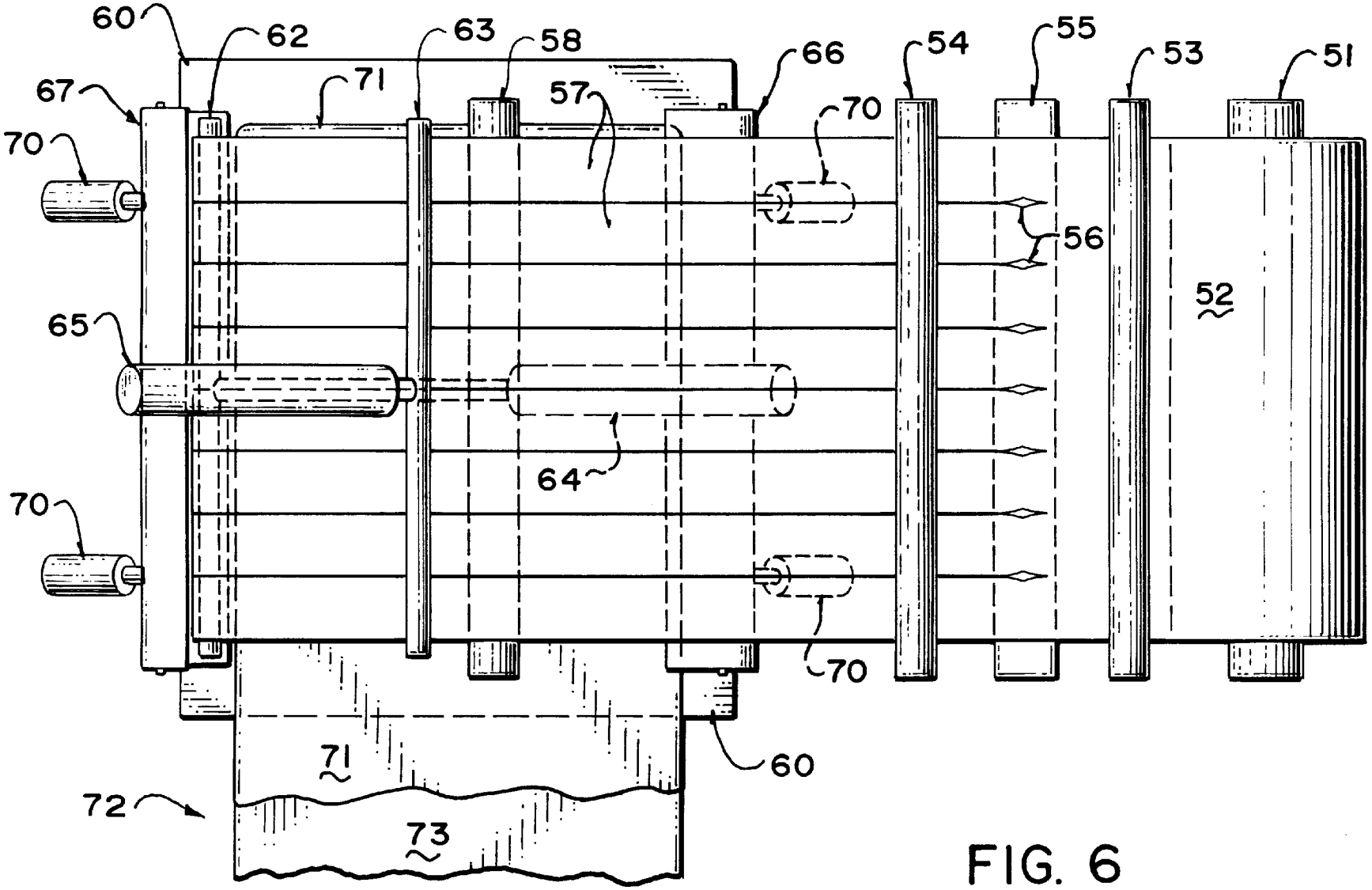
FIG. 6 is a top plan view of the apparatus of FIG. 5.

Turning now to FIGS. 5 and 6, a technique for forming the package structure is shown in more detail. A web 50 is supplied on a master roll 51 and is unwound from the master roll by a feeding and guide system 52 including two nip roller pairs 53 and 54. A slitter bar 55 is mounted transversely to the web and carries a plurality of slitter knives 56 at transversely spaced positions so as to slit the web into a plurality of strips 57 which are carried forwardly by the guide system 52 so that they are maintained in the common plane of the web and are maintained edge to edge. Thus the strips are in effect maintained in the form of a web without any deviation which could cause tension changes. The co-planar strips 57 are fed over a guide roller 58 into a folding system generally indicated at 59 located underneath the feed roller 58.

The folding system 59 comprises a support table 60 having a width sufficient to receive the full width of the web 50, that is the strips in side by side arrangement. The support table 60 has a length sufficient to receive the portions of the folded strips in the structure as previously described. The table 60 is mounted upon a jacking system 61 which is shown only schematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 5, the folding bar 63 is shown in the retracted position and the folding bar 62 is shown in the extended position. The folding bars move alternately between these positions so that the folding bar 62 is firstly retracted and then the folding bar 63 is extended so as to move the strips across the table to form the overlying portions of the strip previously described. The folding bars 62 and 63 extend across the full width of the web so as to engage all of the strips simultaneously and to move those strips simultaneously into the folded positions. The strips thus remain in parallel edge to edge position as they are being folded. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that layer and the fold at the end of the layer to be dropped onto the previous layers and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the strips wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in this art.

The strips are therefore simultaneously laid down in portions folded back and forth on top of one another to simultaneously form a plurality of the layers of the package structure. Each layer is thus formed by a single respective one of the strips. The strip is continuous throughout the layer. In order to provide a continuous strip, one or more master rolls may be spliced into the supply with the splice being formed across the width of the web so that each slit strip also acts to slit through the splice.

The back and forth folding of the strips into the layers is continued until sufficient of the portions are applied to the layer to complete the layer in accordance with the required dimensions of the layer.

As shown in FIG. 5, a bottom clamping plate 71 of a clamping system is generally indicated at 72. The clamping system comprises the bottom plate 71 and a top plate 73. The clamping plates are movable by an actuation system schematically indicated at 74. The clamping plates 71 and 73 are parallel and initially horizontal so that they can be inserted between the portions of the strips across the full width of the web.

The actuation system 74 provides complex movement of the clamping plates. Thus the clamping plates can be extended and retracted in a longitudinal direction independently of one another. The clamping plates can be moved together to reduce the spacing therebetween while remaining parallel in a clamping action so as to squeeze the portions of the web between the clamping plates. The clamping plates can be rotated about a central horizontal axis through 90° and 180° so as to rotate the package structure to present different surfaces at the top. The clamping plates can be translated from a position on top of the table 60 to a separate location for depositing the package structure onto the pallet 46, if this is used in transportation.

The bottom clamping plate 71 is inserted on top of the lowermost portion 29 so that the lower most portion lies underneath the clamping plate and is therefore exposed when the clamping plate and the package are removed from the table 60. In the formation of the package, therefore, the clamping plate 71 is extended into position on top of the table after the lowermost portion 29 is laid, following which the further portions are laid on top of the clamping plate 71.

Figure 7:
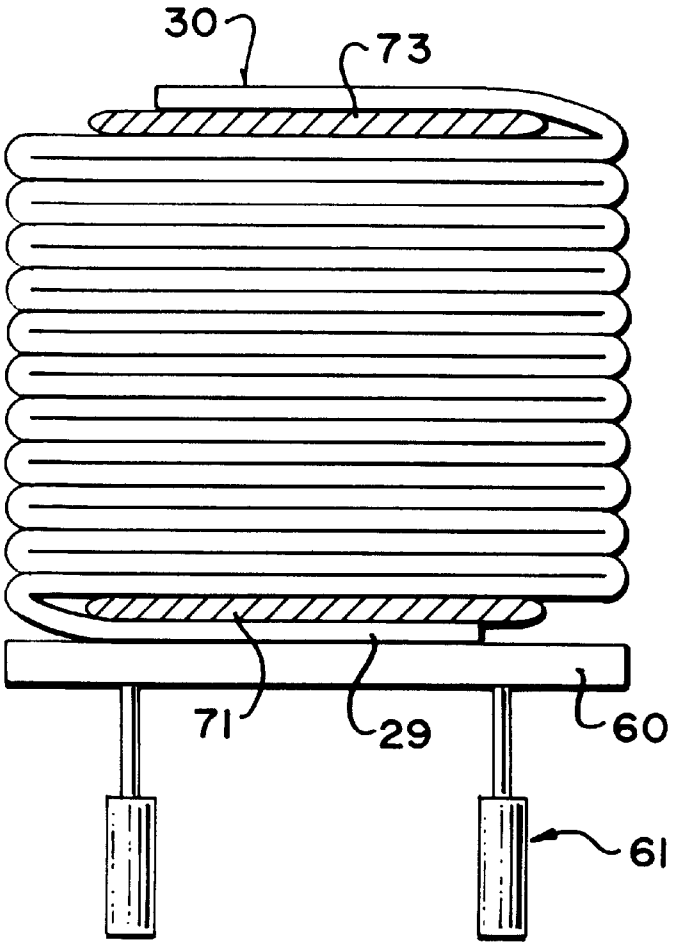
FIG. 7 is a side elevational view of the apparatus similar to that of FIG. 5 showing the top clamping plate moved into position after completion of the required number of portions in each layer, the folding bars and the creasing jaws being omitted for convenience of illustration.

Symmetrically the top clamping plate 73 is moved into position, as shown in FIGS. 7, when the number of portions in the layer is complete and immediately prior to the laying of the last portion 30. Therefore again, the last portion 30 is exposed when the clamping system including the clamping plate 71 and 73 and the package are removed from the table 60.

After the folding action is therefore complete, the clamping action is effected by extension of the top clamping plate 73 and by a clamping movement squeezing the clamping plates together. When this is completed, the package structure can be removed from the table 60 for the further completing actions as described hereinafter and the folding of a further package structure can be recommenced using a second clamping system independent of the first.

Figure 8:
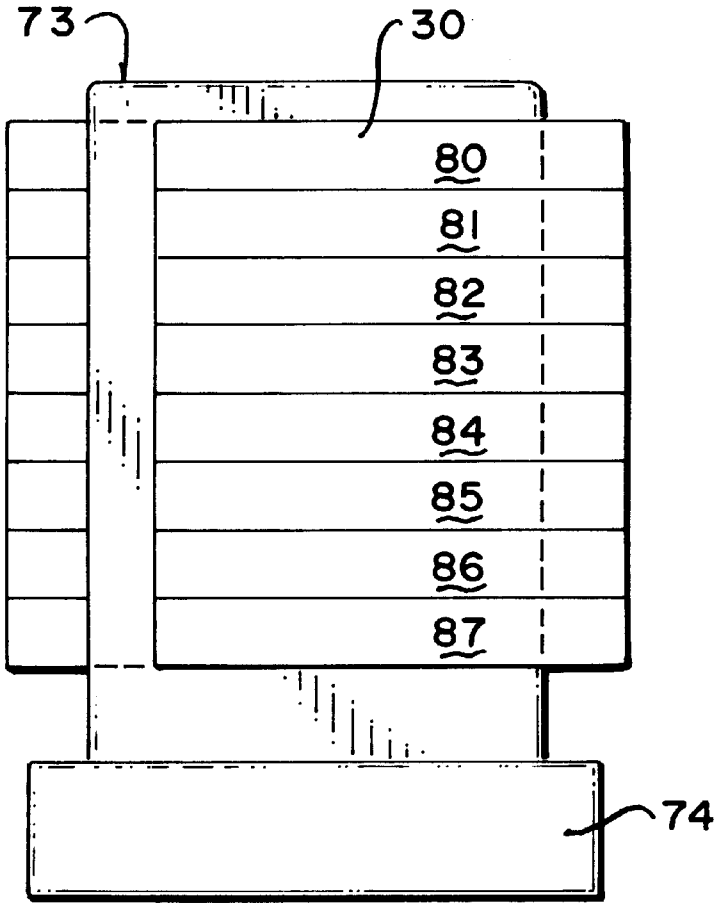
FIG. 8 is a top plan view of the elements of the apparatus as shown in FIG. 7 after removal of the clamped layers from the folding system.

It will be appreciated that in the stage as shown in FIG. 8 in which the package structure is removed from the table 60, each of the layers is separate from and independent of the other layers since each is formed by a respective one of the strips slit from the web 50. Thus in FIG. 8 there are shown eight layers 80 through 87 arranged side by side with the sides edges of the layers in contact as previously described in relation to the package structure shown in FIGS. 1 through 4.

Figure 10:
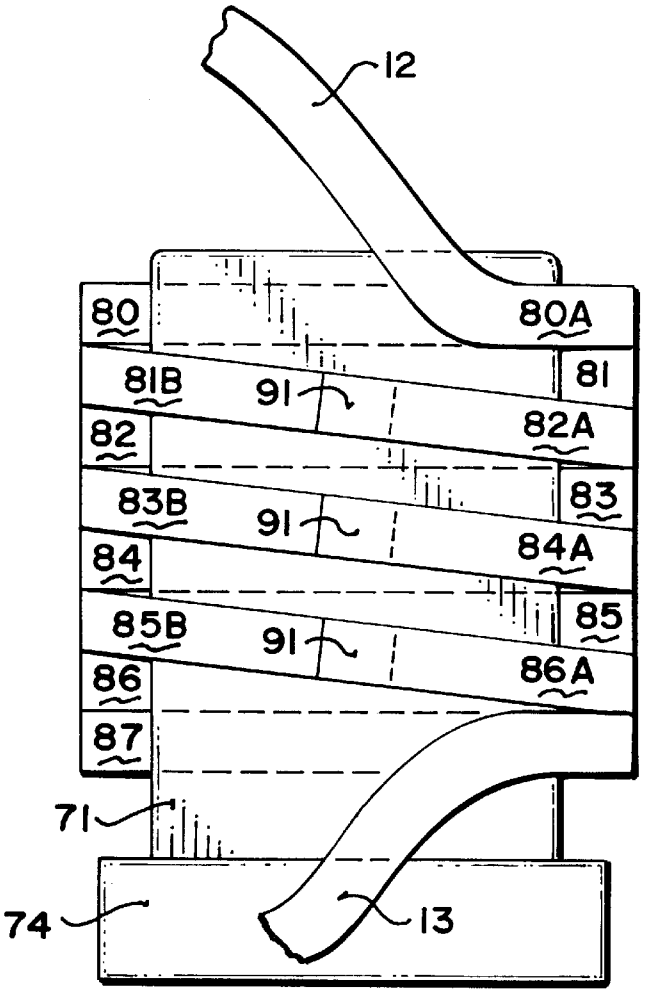
FIG. 10 is a bottom plan view of the elements of the apparatus as shown in FIG. 8 after completion of the splices in the strip between the layers and showing the free ends of the strip at the end layers of the package.
Figure 9:
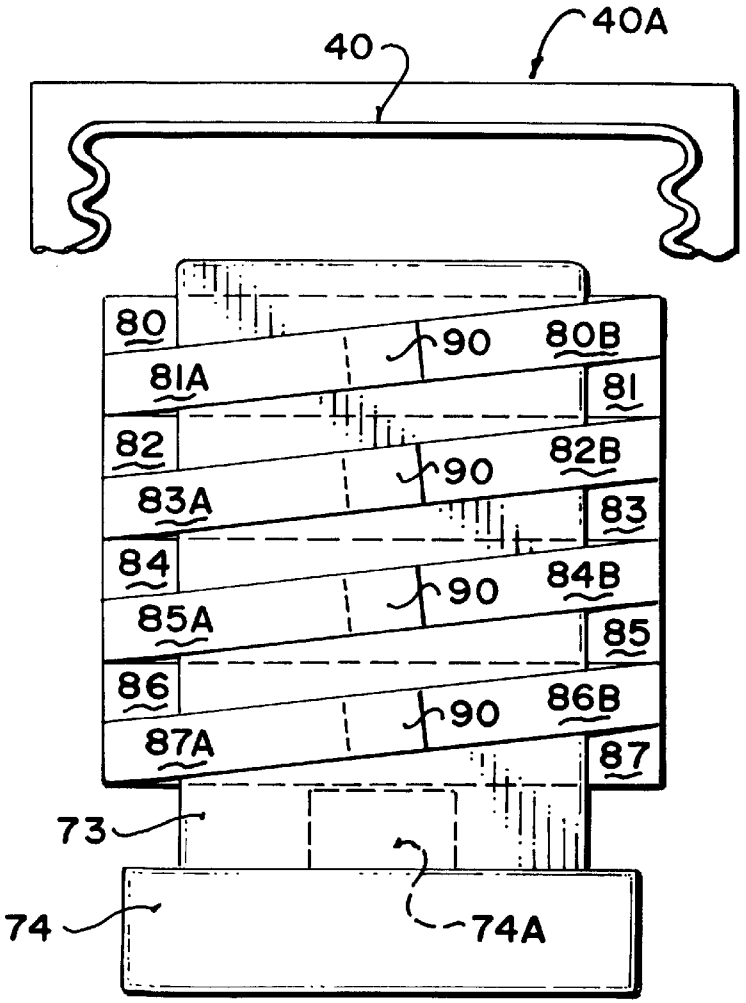
FIG. 9 is a top plan view of the elements of the apparatus as shown in FIG. 8 after completion of the splices in the strip between the layers.

Turning now to FIGS. 9 and 10, the technique for interconnecting the layers is shown. FIG. 9 shows the package structure in the orientation of FIG. 8. FIG. 10 shows the package after it has been inverted or rotated through 180° about the central axis of the clamping system.

Thus it will be noted that one end 80A of the layer 80 forms the leading end 12 of the package. As shown in FIG. 9 a second end 80B of the layer 80 is spliced by a splice 90 to a leading end 81 A of the layer 81.

The opposite end 81B of the layer 81 is spliced by a splice 91 to a leading end 82A of the layer 82. As shown in FIG. 9 the trailing end 82B of the layer 80 is spliced to the leading end 83A of the layer 83 by a splice 91.

In a symmetrical manner, as shown in FIG. 9 the trailing end 84B of the layer 84 is spliced to the leading end 85A of the layer 85 by a splice 90. In addition a further splice 90 interconnects the trailing end 86B of layer 86 and the leading end 87A of the layer 87.

As shown in FIG. 10, two further splices 91 are formed between the trailing end 83B of layer 83 and the leading end 84A of the layer 84, and between the trailing end 85B of a layer 85 and the leading end 86A of the layer 86.

The splices 90 are all formed on top of the top clamping plate 73 using the clamping plate as a support base for effecting a strong seal which in some cases may be usable in the end use machine without the necessity for cutting out the splice. Since the splice is formed while the package is stationary, it can be formed using careful technique such as stitching or heat sealing depending upon the materials involved. In this way the splice can be made as effective as possible so as to minimize the inconvenience of a splice in subsequent processing. Various techniques for splicing are available depending upon the type of material to be spliced.

The splice portions are coplanar with the end portions of the strip and thus lie flat against the side of the package when completed and wrapped as described herein.

After the package is inverted as shown in FIG. 10, the splices 91 can be formed on top of the bottom plate 71 which is now at the top, again using that plate as a support base.

It will be noted from FIGS. 9 and 10 that the spliced portions extend diagonally from one layer to the next. In order to achieve this arrangement from the construction shown in FIG. 8, it is necessary to pull a part of the strip from underneath the top plate 73 at the layers 81, 83, 85 and 87 and to connect that pulled portion to the exposed portion of the strip at the layers 80, 82, 84 and 86. In most cases this necessitates cutting of an extra exposed piece as waste leaving a direct connection forming the diagonally extending spliced portion, such as that defined by the ends 81A and 80B connected by the splice 90.

It will be noted that the splicing technique shown ensures that the strip is spliced with a first surface of the strip from one layer connected to the first surface of the strip on the next layer and the second surface connected to the second surface. In addition, when the strips are unwrapped as shown in FIG. 3, no twist is applied to the strip as the unwrapping transfers from one layer to the next.

After the splices are complete, the package is inserted into the bag 40 supported in a vacuum packing system schematically indicated at 40A. The bag is dimensioned as previously described so that the insertion of the package into the bag can be effected without difficulty. Once inserted into the bag, the clamping plates 71 and 73 are retracted by the actuation system 74 using a push rod 74A to push the package away from the clamping plates so that the package is released from the clamping plates and deposited into the bag 40. When placed into the bag or wrapping material, the vacuum sealing system 40A is operated to complete the compression of the package and the sealing of the vacuum packing material 40 as previously described.

In an alternative technique for forming the package in which the package is competed in place on the table, the bottom splices are formed in place on the table before the layers are stacked on top of the splices. The top splices are then completed at the top of the layers and the package wrapped as described above. Folding can in some cases continue on a second table while the package is finished at the first table. This technique reduces the handling of the package while it is unwrapped thus reducing the possibility of damage.

Figure 11:
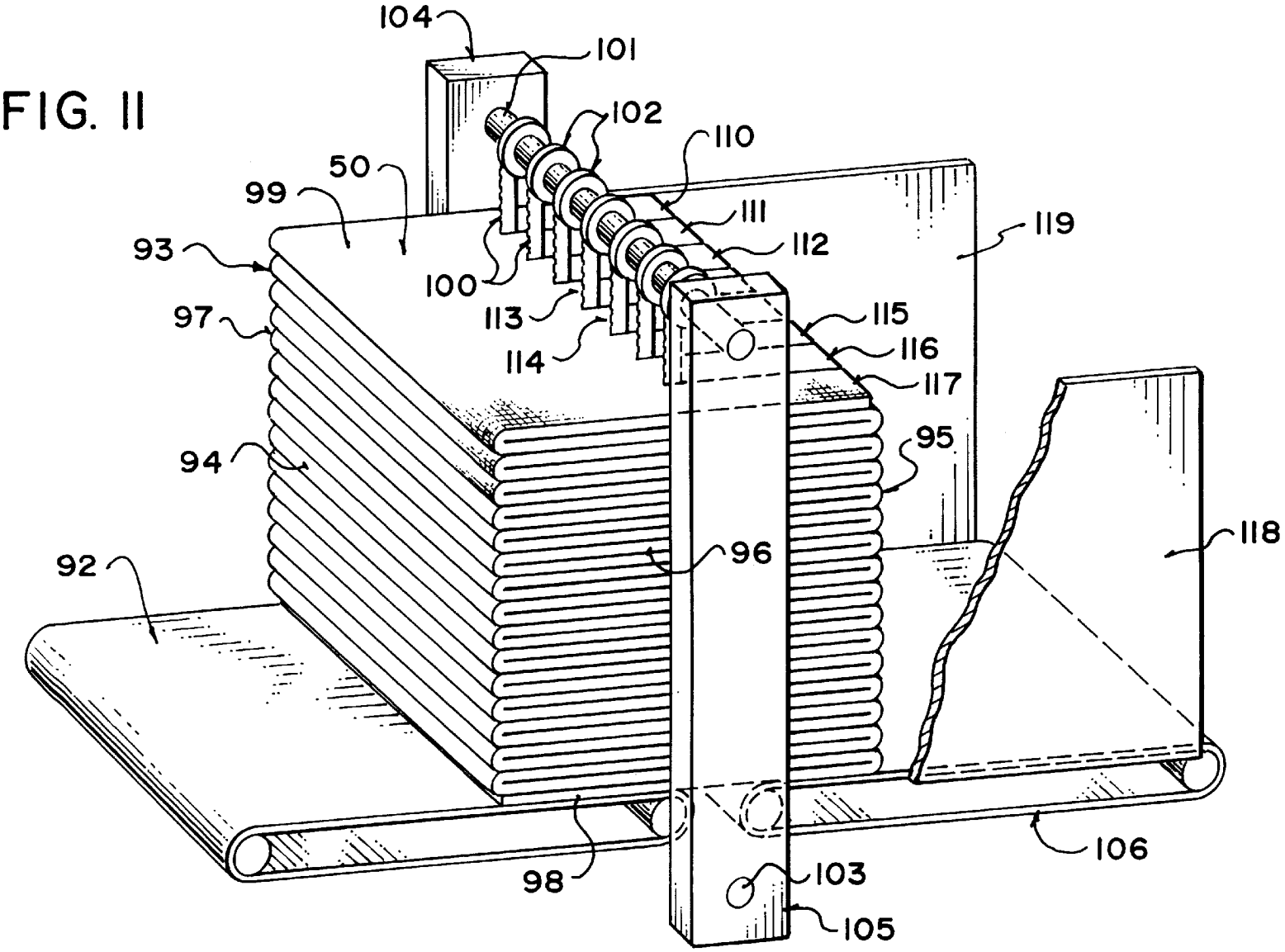
FIG. 11 is an isometric view showing a step in an alternative method for forming a package according to the present invention.

A modified method for manufacturing the package of the structure as shown in FIGS. 1 through 4 uses basically the steps shown in FIGS. 5, 6, 9 and 10 but instead of using the slitter bar 55 of FIGS. 5 and 6 uses the cutting method shown in FIG. 11.

Thus the slitter 55 of FIGS. 5 and 6 is removed and the arrangement as shown in those figures operated to effect a folding action of the complete web without slitting. The web is thus folded back and forth as shown to form a rectangular block of the web.

The body formed by the folded web is then transferred from the table 60 onto a belt conveyor 92. The body 93 has the web 50 folded back and forth as shown so as to form on the body ends 94 and 95 containing the fold lines of the web together with sides 96 and 97 which contain the overlying side edges of the portions of the web. A lowermost web portion 98 is at the bottom of the body and an uppermost web portion 99 is at the top of the body.

A cutting assembly for the body comprises a plurality of band saw blades 100 arranged at spaced positions along a shaft 101. The band saw blades are each mounted on a respective one of a plurality of pulleys 102 so that rotation of the shaft drives the band saw blade along its length. The band saw blades are arranged to stand vertically in parallel vertical planes parallel to the sides 96 and 97 of the body. Each band saw 101 has an idler pulley mounted on a shaft 103 underneath the body and at the discharge end of the conveyor 92. The shafts 103 and 101 are mounted on two parallel support towers 104 and 105 at respective sides of the body. A second conveyor 106 is arranged with an upper run lying in a common horizontal plane with the upper run of the conveyor 92 so as to carry the body through the cutting assembly from an initial uncut position on top of the conveyor 92 to a second position on top of a conveyor 106 in which the body has been cut by the band saws to separate the body into a plurality of parallel layers 110 through 115 which are in effect of the same construction as the layers 80 through 87 of the arrangement shown in FIGS. 5 and 6. Two side guide walls 116 and 117 are provided for engaging the sides 96 and 97 of the body after cutting to maintain the integrity of the body as it is carried through the cutting station and after cutting is complete while the body is standing on the conveyor 106.

The band saw is of a type known as a razor knife band which is intended to effect a cutting action without removing material from the body as the cutting occurs. The razor knife band is of a type having a scalloped front edge chamfered on both sides of the front edge. The fact that the material can be slightly distorted allows the band blade to slide through the material without removing material from the body. The blade is arranged so that it can accommodate the significant length between the shafts 101 and 103 without significantly distorting from the straight line therebetween. An increased width of the blade may therefore be necessary in view of the relatively long length of the blade to provide a cutting action of up to four feet of the height of the body.

Subsequent to the cutting action, the splicing arrangement shown in FIGS. 9 and 10 is effected to connect the layers 110 through 115 in a similar manner to that of the layers 80 through 87. During the splicing action, the body is carried in a pair of camping plates on a clamping system similar to the arrangement 74 in FIGS. 9 and 10. The splicing, compressing, bagging and sealing steps are therefore substantially the same as previously described.

The individual layers for a package structure of this type can therefore be formed in different ways and can be assembled into a package structure, following which the splicing is effected to connect the strip of the layers into a continuous length from a leading end of the package to a trailing end of the package.

The technique using the cutting action through the body is particularly effective in that it ensures that the layers are entirely separate without any interleaving and allows the folding action to be effected more rapidly.

The previous splicing arrangement shown in FIGS. 9 and 10 is suitable for packages where the layers are relatively large and the strip is relatively narrow. In such an arrangement, the strip has sufficient stiffness to remain predominantly vertical when the layer is turned horizontal.

Figure 12:
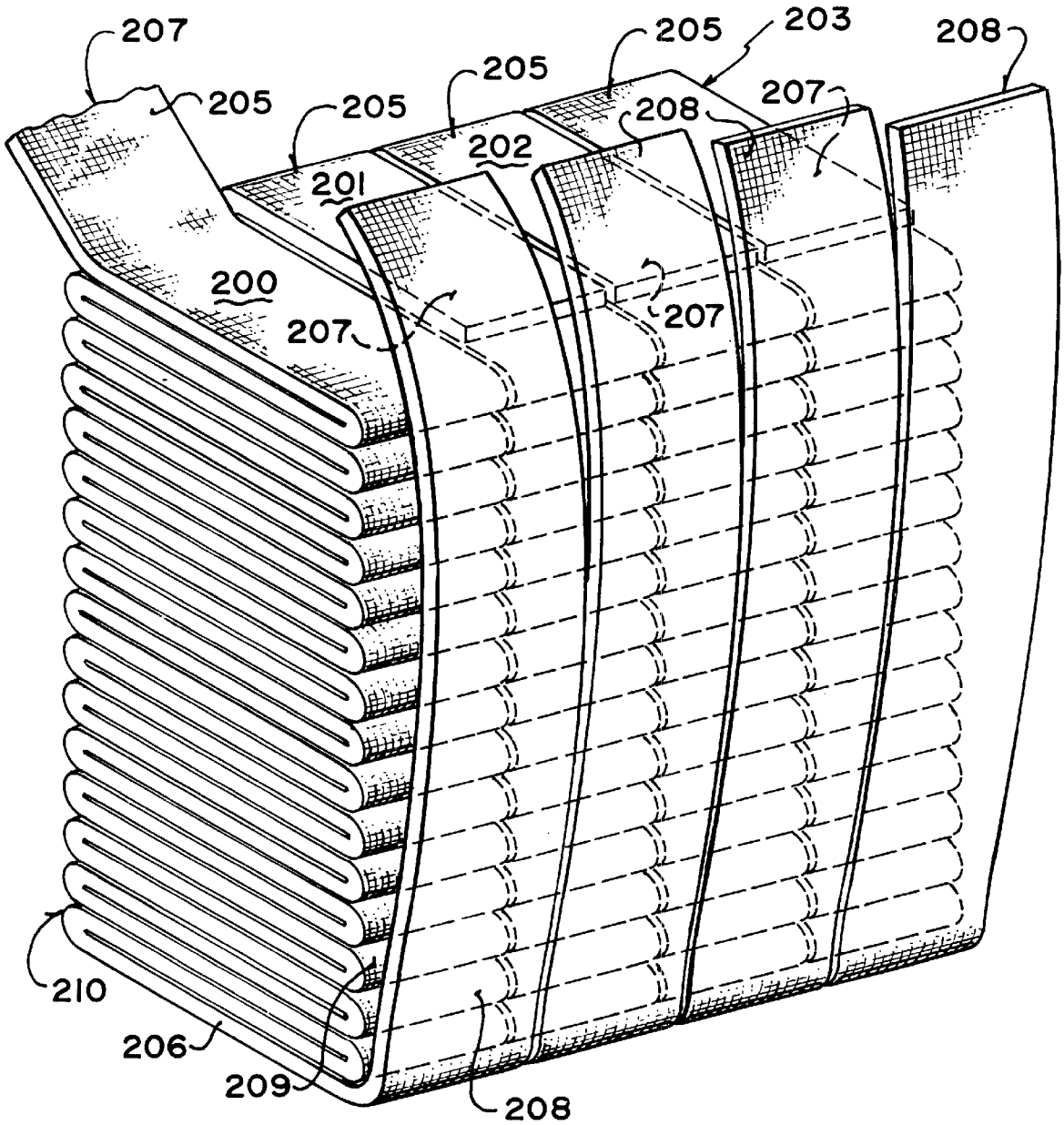
FIG. 12 is a schematic isometric view of a further package structure prepared for splicing of bottom tails to top leads.
Figure 13:
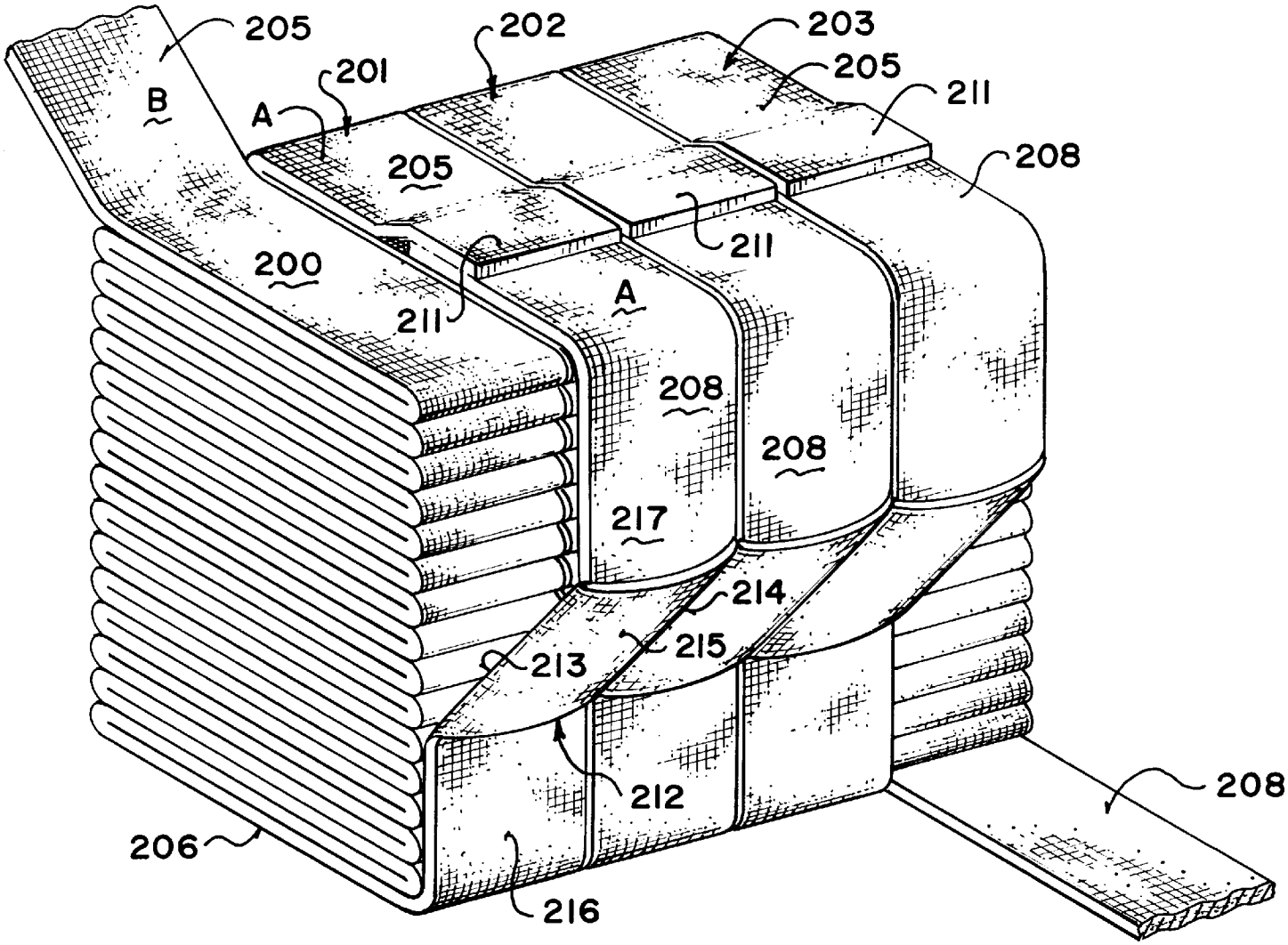
FIG. 13 is a schematic isometric view similar to that of FIG. 12 showing the package after the splices are completed.

Turning now to FIGS. 12 and 13 there is shown a splicing arrangement for use with packages of a strip material of a character which prevents the strip from being turned so that the layers are horizontal as shown in FIG. 3 Such a strip may be relatively wide, may have varying width or may be very thin so that it is not self supporting. Such strips may topple or collapse when turned on edge and the strip portions may become entangled.

It is necessary therefore in such strip forms that the package be oriented so that the layers remain vertical. In this orientation as shown in FIGS. 12 and 13, the layers 200, 201, 202 and 203 are all vertical and side by side so that the individual folded strip portions are horizontal from a horizontal top strip portion 205 of each of the layers to a horizontal bottom strip portion 206 of each of the layers. It is appreciated therefore that in this arrangement each layer will necessarily be unwrapped from the top strip portion down to the bottom strip portion.

The layers are formed as previously described using one or other of the methods as described. Four layers are shown but it will be of course be appreciated that more or less layers can be used.

As shown in FIG. 12, the top end strip portion 205 generally lays across the top of the layer and has an end 207 located on top of the layer. The end portion 205 of the layer 200 is pulled out to define a leading end for the package for attachment to a supply for an end use machine.

The bottom strip portion 206 includes a tail portion 208 which is pulled out from underneath the layer or is formed prior to the formation of the layer as a piece of the strip which hangs out from or beyond one side 209 of the package. The side 209 contains the fold lines of the layer with an opposite side 210 containing the opposite fold lines of the layer.

In some types of material and in some processes, it may be desirable to wrap the package structure as shown in FIG. 12 with the tails 208 not yet connected or spliced and simply free at the top of the packaging material for splicing after transportation and storage is completed. It will be appreciated that the package structure is stationary and therefore readily available for leisurely splicing when it has been moved to the machine to be supplied. Splicing can therefore be effected after the transportation and while the package is awaiting unwrapping or even while the first layer 200 is being unwrapped. The positioning of the tails 208 upwardly along the side of the package to a position at the top of the package makes the tails readily available so that the packaging material previously described can remain in place with simply the top portion of the packaging material opened or removed to allow access to the top portions 205 and the top end of the tail portions 208.

As shown in FIG. 13, the tail portions 208 are spliced to the top portions 205 by a splice 211. As the splice can be done without high speed action necessary, effective splicing systems can be used including stitching and heat sealing which take more time than is generally available on a running line.

The splicing is effected such that the surface A of each strip is attached to the surface A of the strip of the next adjacent layer and similarly the surfaces B are also connected. In some cases this may not be essential to the processing of the strip but in general this is a preferred arrangement to ensure that the strip is supplied in a consistent manner and to avoid twisting of the strip.

In order to ensure that the strip remains without twist, it is necessary to twist the tail portion 208 in a direction which counters the twist which is introduced into the strip as it transfers from layer 200 to layer 201. Careful analysis of the strips and the process of unwrapping will show that the transfer from one layer to the next automatically introduces one turn of twist. It is necessary therefore to counter this turn of twist by a single turn 212 of twist applied to the tail portion prior to splicing at the splice 211. Preferable this turn of twist is applied at a first fold line 213 and a second fold line 214. The first fold line 213 is aligned with the layer 200 and is arranged at an angle of 45° to the horizontal. This forms a horizontal portion 215 of the tail portion which extends from the fold line 213 to the fold line 214 and is therefore in effect horizontal and at right angles to the normal vertical direction of the tail portion 208. The first fold line 213 causes the horizontal portion 215 to lie outside of the vertical portion 216 of the tail portion 208. The second fold line 214 is arranged so that the vertical portion 217 of the tail portion 208 is inside the horizontal portion 215. This arrangement introduces one turn of twist while minimising the length of the horizontal portion 215 and providing a tidy arrangement which is aesthetically attractive and which limits the loose parts available of the tail portion 208 which could otherwise interfere and inter-entangle.

The vertical portion 217 of the tail portion 208 then extends vertically up the layer 201 following which the tail portion 208 extends across the top of the layer 201 to the splice 211.

The horizontal portion 215 is preferable arranged at or immediately adjacent the bottom portion 206 so that almost all of the tail portion 208 is supported by the layer 201 as the layer 200 is withdrawn. There is therefore little or no possibility for the tail portion 208 becoming entangled with the strip from the layer 200 as it is withdrawn and prior to the transfer from the bottom portion 206 through the tail 208 to the top portion 205 of the layer 201.

It is also possible to locate alternate ones of the tail portions at the side 210 of the package structure. In such an arrangement it is preferred to include the twists 212 in the tail portions. However it is possible to omit these twists and to connect the tail portions in straight manner to the top portion of a next adjacent layer. When the tail portions are connected without twist, the automatic twisting effect caused by the transfer of unwrapping from one layer to the next causes the introduction of a twist into the strip. That twist is then cancelled by a twist in the opposite direction at the next transfer position. Such an arrangement may be accommodated in certain circumstances with particular types of strip materials and particular end use machines but this arrangement is clearly not preferred.

The tail portion 208 is folded so that extends up the side 209 to a position above the height of the top portion 205 and is therefore arranged for splicing to the top portion 205 of the next adjacent layer. Alternatively, the twist and the horizontal portion can be located on top of the top portion of the next adjacent layer.

Figure 14:
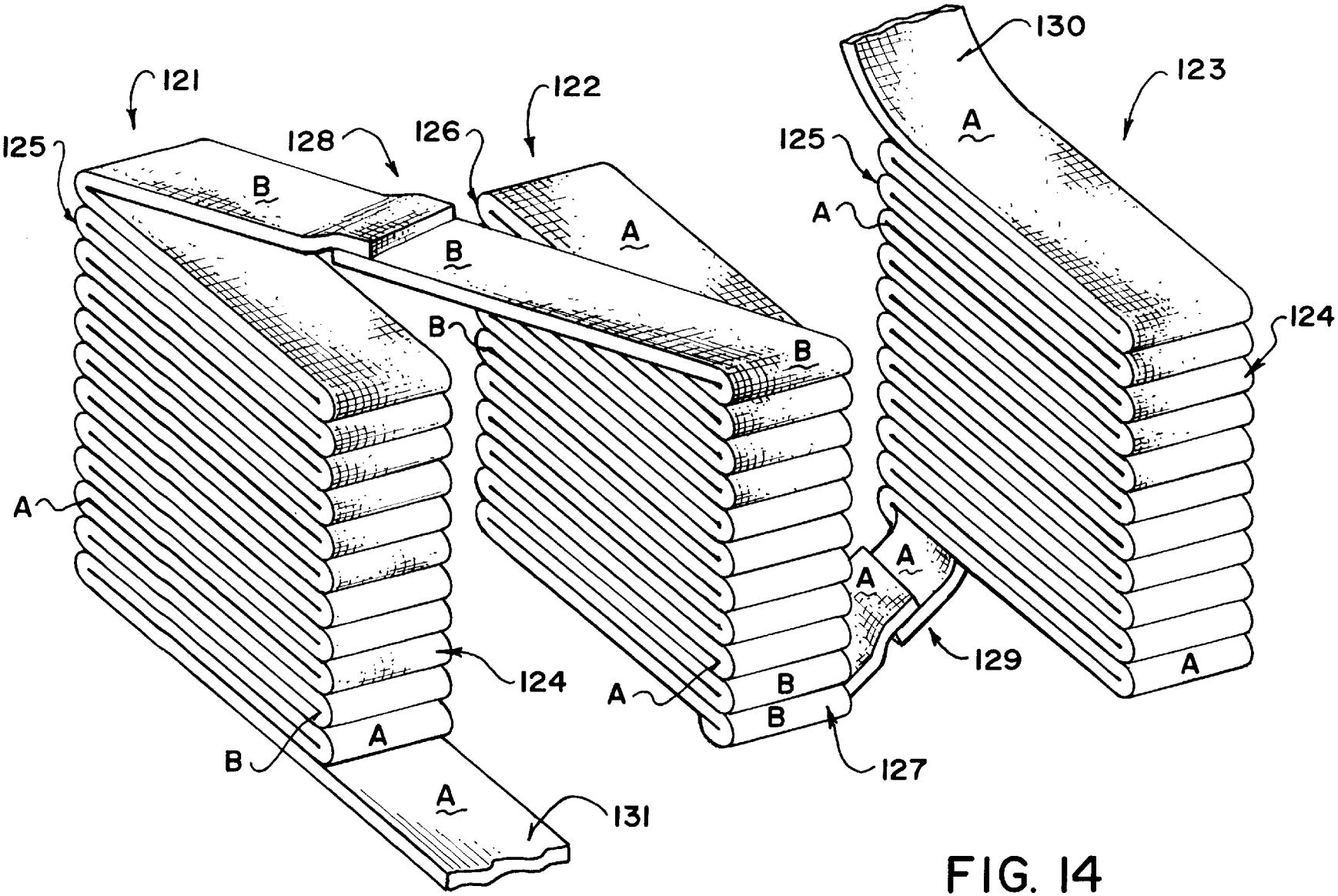
FIG. 14 is a schematic isometric view of a further package structure in which the layers are illustrated in a separated position to show the splices and to show the sides A and B of the material.
Figure 15:
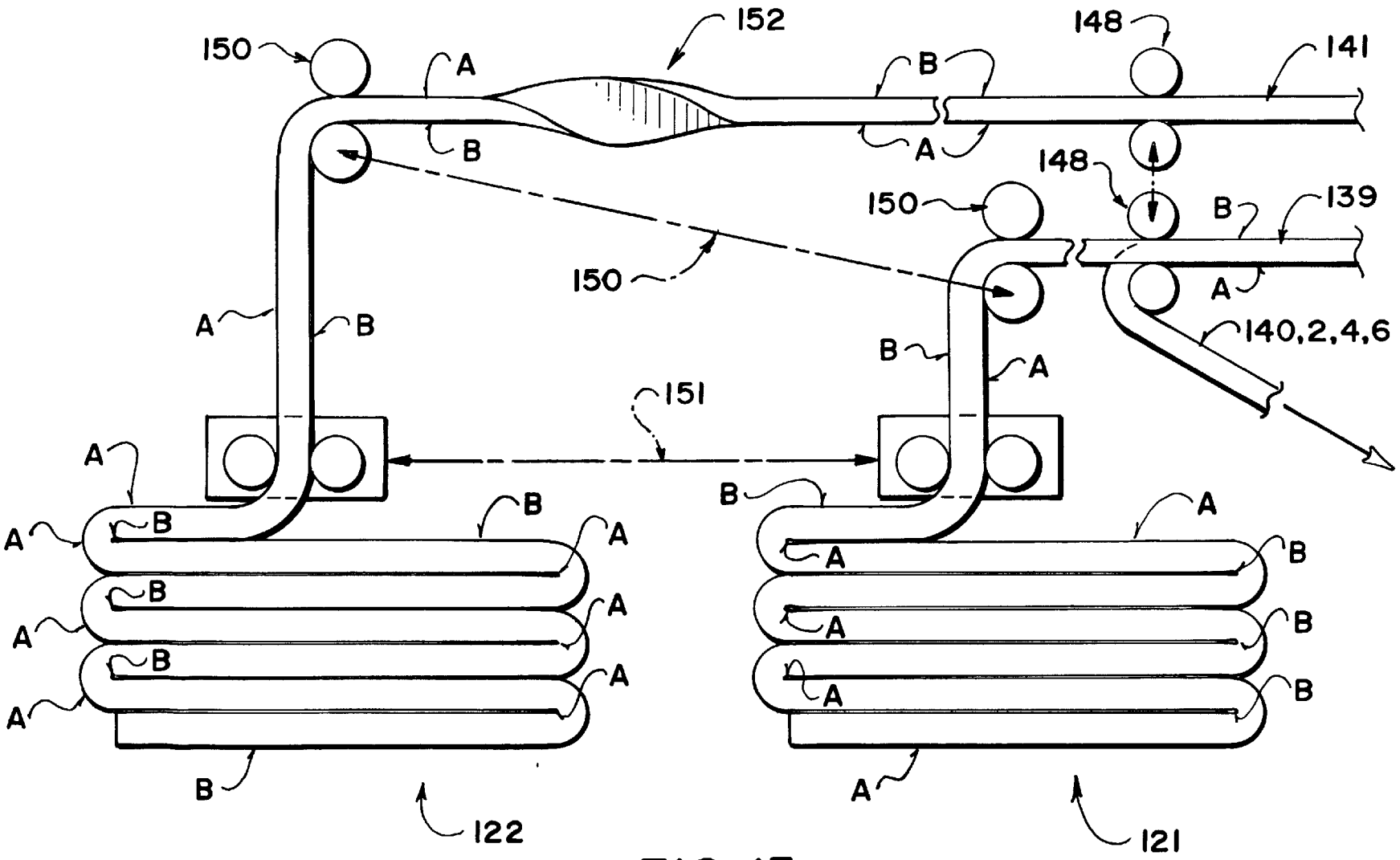
FIG. 15 is a schematic illustration of a side elevational view of a method for forming the package of FIG. 14.
Figure 16:
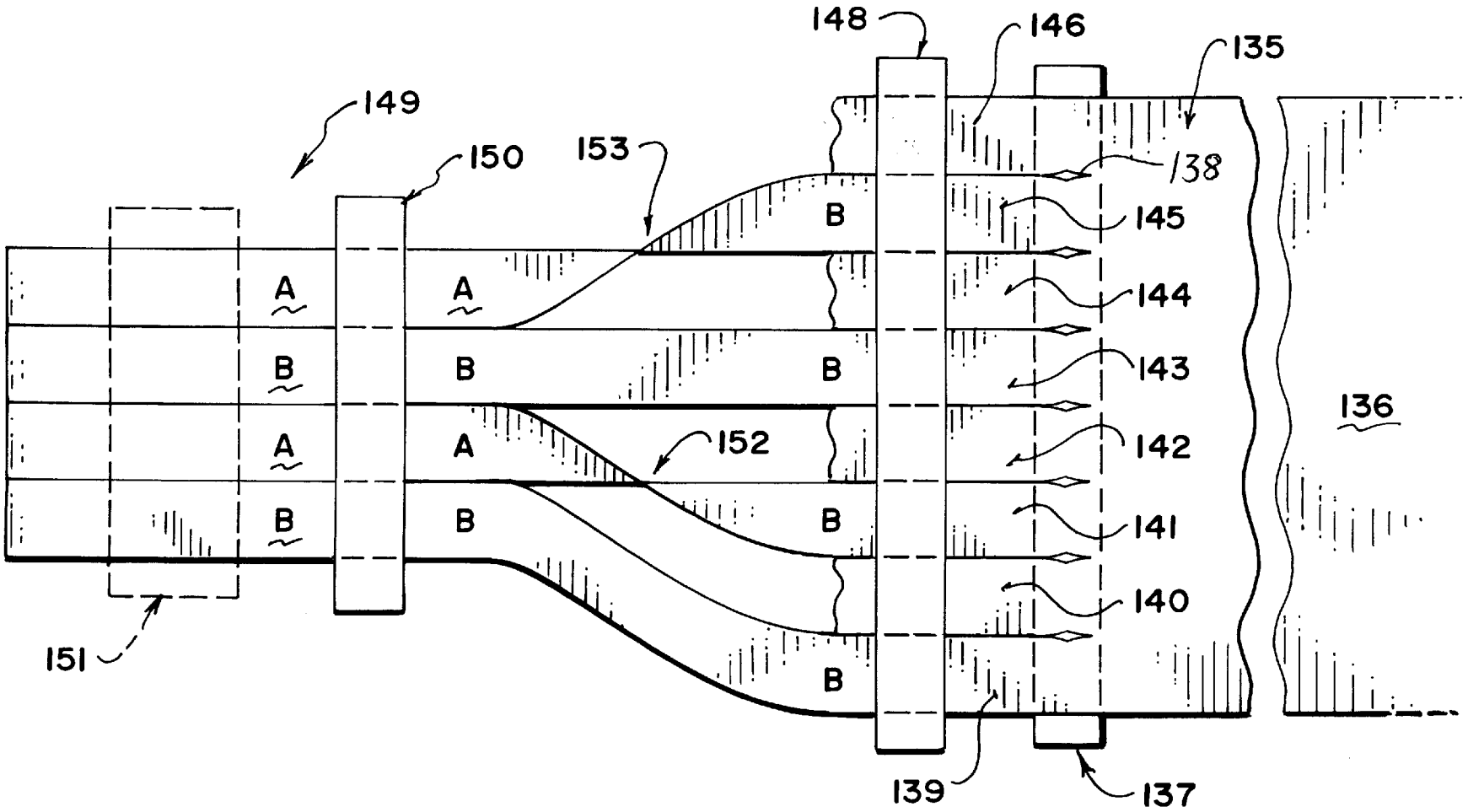
FIG. 16 is a schematic illustration of a top plan view of the method of FIG. 15 for forming the package of FIG. 14.

Turning now to FIGS. 14, 15 and 16 there is shown a further modification of the package structure.

In FIG. 14 are shown three layers of a package structure, but it will of course be appreciated that the package structure is intended to have more than three layers in most cases. The layers are also illustrated as being spaced apart but again it will be appreciated that this is shown merely for convenience of illustration so that the spliced portions extending between each layer and the next can be seen. In practice the layers will be positioned with the side edges thereof immediately adjacent as shown in the previous examples.

In FIG. 14, therefore, there are illustrated three layers 121, 122 and 123. The layers 121 and 123 form layers of a first series of layers and are identical as described hereinafter. The layer 122 forms one layer of a further series of layers which are reversed relative to the layers of the first series again as will be described hereinafter. It will be appreciated that in a practical package construction, there will be a plurality of layers in the first series and a plurality of layers in the second series with the actual number being dependent upon the width of the strip and the intended maximum size of the package structure.

As previously described, each layer is formed from a strip of material which has a first side A which is distinguishable from a second side B. The distinguishing characteristics may be visual or may simply depend upon the type of material forming the first and second surfaces so as to create a different operating effect for those surfaces. In any event, it is important that such material, which has surfaces which are distinguishable, remains with the respective surfaces in a required orientation when paid off to a supply line. At any splices, therefore, the surface A must be connected to the surface A of a next strip portion and the surface B must be connected to the surface B of the next strip portion.

In the layer 123, the strip is folded back and forth as previously described so as to form a first series of fold lines 124 at a first side of the layer and a second series of fold lines 125 at an opposed second side of the layer. As will be apparent from reviewing the structure as illustrated in FIG. 14, the first series of fold lines 124 have the first surface A on the outside of each fold facing outwardly and the second surface B on the inside of each fold facing inwardly. The second series of fold lines 125 are in effect opposite to the first series in that the first surface A is on the inside of each fold and the second surface B is on the outside of each fold.

The layer 121 of the first series is identical to that of layer 123 in that it has a first series of fold lines 124 and a second series of fold lines 125 having the above characteristics.

The layers of the second series, for example the layer 122, are arranged in opposite orientation. Thus it has a first series of fold lines 126 and a second series of fold lines 127. The fold lines 126 have the surface A on the outside and the surface B on the inside. The fold lines 127 have the surface B on the outside and the surface A on the inside.

The layers of the second series are inverted or reversed in orientation so that the first fold lines 126 at the first side of the layer 122 are arranged along side the second fold lines 125 at the second side of the layer 123. Similarly the second fold lines 127 of the layer 122 are arranged immediately along side the first fold lines 124 of the layer 123.

This change in orientation of the alternate layers of the second series can be obtained by mechanically moving the layers of the second series after they are formed so that they are either inverted by rotation about a horizontal axis (in the orientation as illustrated) or they are reversed by rotation about a vertical axis. It will be appreciated that the layers have only in effect two possible orientations and are otherwise symmetrical.

As an alternative, the change in orientation may be obtained by the method as described hereinafter in regard to FIGS. 15 and 16.

In FIG. 14 is further shown the spliced portions which extend diagonally across from one layer to the next in the manner previously described herein. As only three layers are illustrated, there are only two spliced portions indicated at 128 and 129. The spliced portion 128 extends across the top end of the package structure from the uppermost strip portion of the layer 121 to the uppermost strip portion of the layer 122. As shown, as will be appreciated by following the position of the two surfaces of the strip, it will be noted that the upper surface B of the strip portion of the layer 121 is connected to the surface B of the strip portion of the layer 122 and the surfaces A which are on the underside are also connected.

The spliced portion 129 is similarly arranged but is positioned at the bottom of the layers interconnecting the bottom strip portion of the layer 122 to the bottom strip portion of the layer 123. Again it will be noted that the surface A is connected to the surface A and the surface B is connected to the surface B. The complete package structure includes a leading end 130 and a trailing end 131. The package structure may be orientated, manipulated and packaged as previously described herein.

Turning now to FIGS. 15 and 16, there is shown a method of forming the package structure of FIG. 14. The method includes supplying a web 135 from a supply 136 to a stationary slitting bar 137. The slitting bar is arranged across the web with a series of slitting knives 138 at spaced position across the bar and across the web so as to slit the forwarding web into a plurality of side by side strips 139 through 146. From the slitting bar, the slit strips pass through a feeding system 148 which may comprise a pair of nip rollers as shown.

At the feeding system 148, the strips may be separated into two groups for packaging separately. This reduces the width of the package from the initial width of the webs down to a package structure which is narrower than the width of the web. More than two packaging systems may be provided thus further reducing the width of the package structure. In the examples shown, the strips 139, 141, 143, 145 are fed to a first packaging system schematically indicated at 149. The strips 140, 142, 144, 146 are fed to a second packaging system not shown. Instead of splitting the strips alternately as shown, it is also possible to split the strips into two groups which are simply separated one half of the distance across the web so the first sections of strips pass to the first packaging system and the second section of strips pass to the second packaging system.

The packaging systems are identical so that only one will be described.

The packaging system 149 comprises a feed system 150 which may comprise a pair of nip rollers between which the strips pass. The strips are converged inwardly so that at the feed rollers 150 the strips lie side by side. At the same time alternate ones of the strips are twisted about an axis longitudinal of the strip so as to turn the strip through 180° and invert the alternate strips relative to the intervening strips. Thus the strips 141 and 145 are twisted, as indicated at 152 and 153, through 180° relative to the strips 139 and 143 which remain untwisted. It will be appreciated therefore by following the surfaces A and B that the strips 141 and 145 are inverted at the rollers 150 relative to the strips 139 and 143. From the rollers 150, the strips are fed side by side to a folding carriage 151 for folding into the separate layers as previously described. The carriage 151 is shown only schematically as this can be of the type shown in FIGS. 5 and 6 or can be of the type shown in copending application Ser. No. 08/939881 filed Sep. 29$^{th}$ 1997, the disclosure of which is incorporated herein by reference.

The rollers 150 and the carriage 151 are shown in FIG. 15 in schematic illustration In two separate locations to enable illustration of the layers 121 and 122 separately.

The carriage 151 thus lays down both the layers 121 and 122 side by side and simultaneously. However it will be noted by following the surfaces A and B that the two layers are inverted or rotated in effect by the simple expedient of twisting the strip as it is forwarded to the folding carriage system.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A package of a strip comprising:

a strip having a first side edge, a second side edge, a first surface and a second surface;

a plurality of stacks of the strip, wherein each stack comprises a plurality of overlying strip portions, with each strip portion of the stack being folded relative to one next adjacent strip portion about a first fold line transverse to the strip and relative to a second next adjacent strip portion about a second fold line transverse to the strip and spaced from the first fold line;

such that the first side edges of the strip portions are aligned and also the second side edges of the strip portions are aligned;

wherein for each stack, the first fold lines at a first end of the stack have the first surface facing outwardly and the second surface facing inwardly and the second fold lines at a second end of the stack opposite to the first side end have the second surface facing outwardly and the first surface facing inwardly;

wherein the stacks are arranged to define a first stack and a second stack with the first edge of the first stack facing the second edge of the second stack within the same package;

wherein the first stack is arranged such that the first fold lines are all at one end of the package and the second fold lines are all at an opposed second end of the package;

and wherein the second stack is arranged such that the first fold lines are all at said opposed second end of the package and the second fold lines are all at said one end of the package.

2. The package according to claim 1 wherein the first stack is one stack of a first series of stacks and the second stack is one stack of a second series of stacks with the stacks of the first and second series being arranged alternately across the package, wherein the stacks of the first series are arranged such that the first fold lines are all at one end of the package and the second fold lines are all at an opposed second end of the package and wherein the stacks of the second series are arranged such that the first fold lines are all at said opposed second end of the package and the second fold lines are all at said one end of the package.

3. The package according to claim 1 wherein the strip is continuous through each stack from a first end portion of the strip at one end of the stack to a second end portion of the strip at an opposed end of the stack, such that a full extent of the strip from the first end portion to the second end portion can be unfolded from the stack by pulling the strip from either end portion.

4. A method of forming a package of a strip of material comprising:

providing a web of a material in a supply;

forwarding the web from the supply;

slitting the web at a plurality of slitting knives at spaced positions across the width of the web to form a plurality of separate strips of the material, each strip having a first side edge, a second side edge, a first surface and a second surface;

simultaneously laying the strips to form a plurality of parallel side by side stacks each containing a strip of the material;

each stack being formed by folding the strip to form a plurality of folded portions of the strip, wherein each portion of the layer is folded relative to the next portion of the layer about a line transverse to the strip;

such that the first surface of each portion faces the first surface of one next adjacent portion and the second surface of each portion faces the second surface of a second opposed next adjacent portion;

such that the first side edges of the portions are aligned and also the second side edges of the portions are aligned;

and, prior to forming the layers, twisting at least one of the strips about its length through 180 degrees so as to invert the strip in its respective stack relative to the strip of at least one of the other stacks.

5. The method according to claim 4 including:

laying the strips so as to be continuous though each stack from a first end portion of the strip at one end of the stack to a second end portion of the strip at an opposed end of the stack, such that a full extent of the strip from the first end portion to the second end portion can be unfolded from the stack by pulling the strip from either end portion;

and connecting the first end portion of said at least one strip to one of the first and second end portions of the strip of a next adjacent stack by a spliced portion.

6. The method according to claim 5 wherein the first end portion of said at least one strip is connected by said spliced portion to the first end portion of the strip of the next adjacent stack.

7. The method according to claim 6 wherein the spliced portion is coplanar with and connected to the first end portion of said at least one strip and the first end portion of the strip of the next adjacent stack and extends diagonally across the stacks.

8. The method according to claim 4 including twisting each alternate one of the strips about its length through 180 degrees so as to invert each alternate strip in its respective stack relative to the strip of the other stacks.

9. The method according to claim 5 wherein the package is oriented for unwrapping such that the stacks are horizontal and such that one end of the package is provided by an uppermost one of the stacks and a second end of the package is provided by a bottom one of the stacks and such that the first and second end portions of the stacks lie in vertical planes.

10. A package of a strip comprising:

a strip having a first side edge, a second side edge, a first surface and a second surface;

a plurality of stacks of the strip, wherein each stack comprises a plurality of overlying strip portions of the strip, with each strip portion of the stack being folded relative to one next adjacent strip portion about a first fold line transverse to the strip and relative to a second next adjacent strip portion about a second fold line transverse to the strip and spaced from the first fold line;

such that the first side edges of the strip portions are aligned and also the second side edges of the strip portion are aligned;

wherein, for each stack, the first fold lines at a first end of the stack have the first surface facing outwardly and the second surface facing inwardly and the second fold lines at a second end of the stack opposite to the first end have the second surface facing outwardly and the first surface facing inwardly;

wherein the stacks are arranged to define a plurality of first stacks and a plurality of second stacks with the first and second stacks arranged alternately through the package;

wherein the strip in each stack is continuous from a first end strip portion to a second end strip portion;

wherein the first end strip portions of the stacks are arranged at one face of the package and the second end strip portions of the stacks are arranged at a second opposed face of the package;

wherein the first end strip portion of each first stack is connected by a splice connection to the first end strip portion of a next adjacent second stack and the second end strip portion of each second stack is connected by a splice connection to the second end strip portion of a next adjacent first stack such that the strip is continuous though the package;

wherein the first stacks are arranged such that the first fold lines are at one end of the package and the second fold lines are at an opposed second end of the package;

and wherein the second stacks are arranged such that the first fold lines are at said opposed second end of the package and the second fold lines are at said one end of the package;

such that the first surface of the strip is connected to the first surface of the strip and the second surface of the strip is connected to the second surface of the strip throughout the package.

11. The package according to claim 10 wherein the splice connection between the first end strip portion of each first stack and the first end strip portion of each next adjacent second stack is coplanar with said one end face of the package and the splice connection between the second end strip portion of each second stack and the second end strip portion of each next adjacent first stack is coplanar with said second opposed end face of the package.

12. The package according to claim 11 wherein the package is oriented for unwrapping such that the stacks are horizontal and such that the end faces of the package lie in vertical planes.

* * * * *

UNITED STATES PATENT AND TRADEMARK OFFICE

CERTIFICATE OF CORRECTION

PATENT NO. : 6,009,689
DATED : January 4, 2000
INVENTOR(S) : Lawrence J. O'CONNOR It is certified that error appears in the above-identified patent and that said Letters Patent is hereby corrected as shown below:

On the face of the patent, at [73], change "Bangladesh" to --Barbados--.

Signed and Sealed this

Twenty-fifth Day of July, 2000

*Attest:*

Q. TODD DICKINSON

*Attesting Officer*

*Director of Patents and Trademarks*